US005976249A

United States Patent [19]

Stahl

[11] Patent Number: 5,976,249

[45] Date of Patent: Nov. 2, 1999

[54] VARNISHING HEAD

[75] Inventor: Gerhard Stahl, Ahrweiler, Germany

[73] Assignee: Josef Schiele oHG, Niederzissen, Germany

[21] Appl. No.: 08/939,734

[22] Filed: Oct. 6, 1997

[30] Foreign Application Priority Data

Oct. 11, 1996 [DE] Germany ..... 296 17 525 U

[51] Int. Cl.[6] ..... C23C 26/00

[52] U.S. Cl. ..... 118/50; 118/326; 118/404; 118/407; 118/DIG. 11

[58] Field of Search ..... 118/50, 326, 404, 118/407, DIG. 11; 427/294, 430.1

[56] References Cited

U.S. PATENT DOCUMENTS 3,900,866 8/1975 Bell et al. ..... 118/50
5,298,072 3/1994 Schiele et al. ..... 118/50
5,335,681 8/1994 Schmid ..... 118/50

FOREIGN PATENT DOCUMENTS

4207090C2 9/1993 Germany .
92 06 304 U1 10/1998 Germany .

*Primary Examiner*—Laura Edwards
*Attorney, Agent, or Firm*—Michael J. Striker

[57] ABSTRACT

A varnishing head orientable toward a workpiece for a relative movement of a workpiece and application of a surface coating substance on a workpiece surface, the varnishing head comprising an application nozzle provided with a connection to a surface coating substance source, a suction nozzle provided with a suction connection, the application nozzle being formed as a slot nozzle adapted to face the workpiece surface with a small distance from it and having a mouth which is formed by a slot extending transversely to a movement direction, the suction nozzle being open at a distance from the application nozzle as considered in the movement direction in the workpiece.

14 Claims, 4 Drawing Sheets

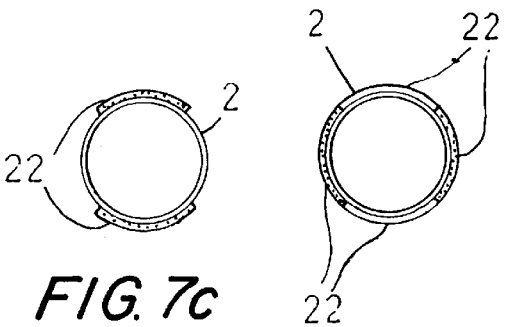
FIG. 7d
FIG. 7c
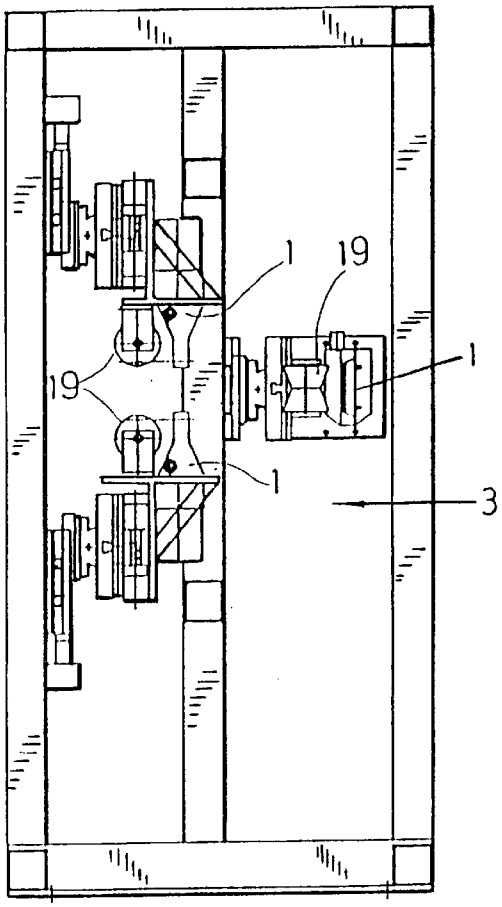
FIG. 7b
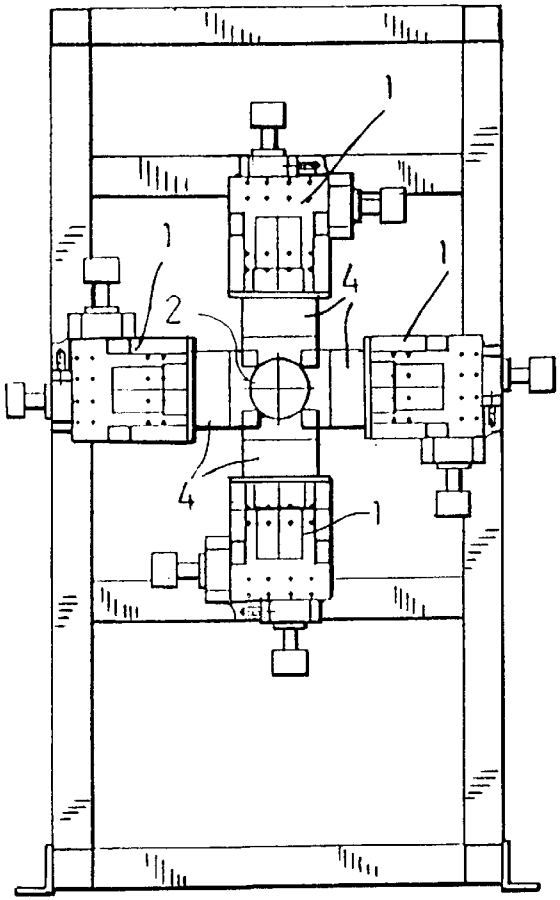
FIG. 7a

VARNISHING HEAD

BACKGROUND OF THE INVENTION

The present invention relates generally to a varnishing head.

More particularly, it relates to a varnishing head which is formed so as to move over a surface of a workpiece at a small distance from it and thereby to apply a surface coating substance onto the surface, wherein the head is provided with an application nozzle having a connection to a surface coating agent, and a suction nozzle which is open in this region and provided with a suction connection.

The present invention also relates to a varnishing device which is provided with at least two such varnishing heads.

A varnishing head of the above mentioned general type is disclosed in the German patent document DE 42 07 090 C2. It is designed so as to coat services of workpieces at a minimum distance with varnish, paint or a similar coating liquid or paste. The workpiece passes through a recess of the varnishing head along it.

With the suction connection, air passes along the workpiece surface on the application nozzle and is aspirated in the suction nozzle. The dynamic underpressure in the air stream aspirates the liquid into the application nozzle and ejects it against the workpiece surface. Due to the relative movement of the workpiece and the varnishing head, the suction nozzle moves over the freshly coated region and aspirates all excessive liquid, paint, etc. The application nozzle and the aspiration nozzle can operate in a reverse order. In a subsequent device the paint is separated and again returned to the application nozzle.

The known varnishing head operates during coating of small edges in a satisfactory manner. However, for application of a wide coating strips, in particular on a not offset surfaces, it is less suitable. Moreover, during the coating process a relatively large paint quantities are applied, which thereafter must be again aspirated and returned into the circulation.

SUMMARY OF THE INVENTION

Accordingly, it is an object of the present invention to provide a varnishing head of the above mentioned general type, which avoids the disadvantages of the prior art.

More particularly, it is an object of present invention to provide a varnishing head which is formed so that the application is performed in a more economical manner and distributed over a greater width.

In keeping with these objects and with others which will become apparent hereinafter, one feature of present invention resides, briefly stated in a varnishing head in which the application nozzle is formed as a slot nozzle which faces a workpiece with a small distance from it, and its opening is formed by a small slot extending transversely to a movement direction, wherein the suction nozzle opens toward the application nozzle before or after the workpiece.

It is to be understood that the varnishing nozzle in accordance with the present invention is suitable not only for application of varnish, but also any flowable coating medium of any type as long as it has a viscosity required for the application. The width of the slot of the application nozzle can be adjusted to the viscosity of the liquid to be applied and to the flow speed of the air before the slot, so that the inventive varnishing nozzle can be suitable for all liquids which before were applied by spraying, stripping, rolling, etc.

A substantially identical throughput is obtained in a small slot over its longitudinal dimension at each point, as long as all aspirated air stream passes through these points. The width of the slot and the speed of the air stream (a function of the distance from the workpiece surface and the power of the suction blower) can be selected in dependence on the applied liquid so that only such a liquid quantity passes through the application nozzle which must be applied. Only a small liquid excess is needed for providing the reliable formation of a covering and uniform coating of the liquid on the workpiece.

When the varnishing head runs out relative to the edges of the workpiece, at which the coating to be applied by the varnishing head starts or finishes, a droplet accumulation is formed from the liquid which can not be aspirated due to high adhesion to the substrate but is still flowable. In accordance with another embodiment of the invention, a further similar device is provided which is identified for the purpose of distinguishing from the first mentioned device as a droplet aspiration nozzle, but actually has the same construction as the aspiration nozzle. The droplet aspiration nozzle aspirates the droplet accumulation which can be produced during passage of the transition between the suction nozzle and the droplet aspiration nozzle.

The droplet aspiration nozzle can be provided with its own suction connection for connecting to its own suction device. Preferably, it can be connected together with the suction nozzle to its suction connection. In a border case, the suction nozzle and the droplet aspiration nozzle can be arranged in a common, tubular housing with a separation wall extending transversely to the movement direction of the workpiece and limiting the both nozzles.

The droplet aspiration nozzle can have a smaller or greater length than the suction nozzle when considered transversely to the movement direction. At the same time, it can have the same length, so that an air stream between the nozzles can be adjusted which is not inclined to provide the same application thickness. However, the opening surface of the droplet aspiration nozzle preferably is smaller than that of the suction nozzle, so that in the opening of the droplet aspiration nozzle a higher flow speed is provided than in the suction nozzle. Therefore, the droplets deposited on the transverse edges are forcibly pulled into the droplet aspiration nozzle.

The opening of the slot which forms the application nozzle can extend rectilinearly, when the workpiece surface to be coated forms a surface with a generatix extending over a straight line which is parallel to the slot. For mass operation the distance to the workpiece surface over the whole slot length must be as constant and small as possible.

When the workpiece surface is curved transversely to the movement direction substantially on a rounded longitudinal edge, the slot must be curved so that the above mentioned condition must be fulfilled. The same is true for the stepped edges.

When the suction nozzle is formed with the throughgoing substantially uniform cross-section to the suction connection, then its flow resistance is small. However, the underpressure which acts in it substantially varies when a workpiece moves into the suction region or out of this region. In order to eliminate this disadvantage, it is proposed to provide a screen or narrowing between the suction nozzle and the suction connection. It prevents unacceptable drop of the pressure in the machine during short interruptions of the workpiece coating and thereby negative influence on the liquid application.

Such a screen is however possible only in the inventive varnishing head since in it, due to the extremely small liquid quantity to be aspirated, in the suction nozzle only a high pressure is maintained but not a high air throughput. The inventive varnishing head therefore can be connected to a suction blower with an unconventionally low throughput power.

Basically, the suction nozzle must have at least such a length, when measured in the movement direction, as the slot. This provides the application of the liquid which is sharply limited at the sides and is therefore very efficient for coating the small side of a plate or for application of a sharply limited paint strip.

Alternatively, it can be advantageous when the suction nozzle extends at least at one transverse end over the slot of the application nozzle. Thereby in this region, during passing an applied strip a transverse flow of the aspiration air is produced, so that the side end of the applied liquid strip is not sharply limited but extends a little. If several strips of paint are applied near one another, and the side edge is located on the side edge, the extending regions of the neighboring strip edges overlap one another and a uniform paint application is provided. It no longer can be recognized where originally the side edges of the applied paint stripes were located.

In accordance with another embodiment of the present invention, it is especially advantageous when the outwardly or laterally extending ends of the suction nozzle form tips, transversely to the movement direction.

In accordance with a further advantageous feature of the invention, the suction nozzle extends at both sides outwardly beyond the application nozzle, and it must be avoided that the suction nozzle laterally extends beyond the surface to be coated. For this reason, the varnishing head is provided with several, exchangeable nozzle devices which can be used when needed.

It has been mentioned that it is important that the distance between the application nozzle and the workpiece surface to be coated is as small and as uniform as possible.

It is possible to provide the varnishing head with a subsequent regulation as disclosed for example in the German patent document DE-GM 93 17 655.4. However regardless of the fact that such a regulation is expensive, it moreover causes or is inclined to post-vibrations. Therefore, it does not always operate reliably for the inventive varnishing head in permanent operational conditions.

It is proposed to provide a guide which runs on the workpiece. Both nozzles are rigidly connected to the guide, while the movably supported varnishing head, which for example is pressed by springs against the workpiece, is always positively held in the same spacial arrangement to the workpiece. This guide guarantees the optimal action of the inventive varnishing head.

Naturally, the inventive varnishing head can operate also without the above mentioned guide, but probably in a suboptimal manner in some cases.

The invention also deals, as mentioned above, with a varnishing device having at least two offset varnishing heads, which are arranged so that the coating strips applied by them on the workpiece jointlessly adjoin one another. With known varnishing heads, such a coating was not possible since they were not oriented for varnishing the side edges of the workpiece. With the inventive varnishing head, to the contrary, it is possible with a corresponding design, to coat flat surfaces.

It is especially advantageous when the varnishing heads which are offset relative to one another by 90° are provided. Each of the varnishing heads covers a quadrant of the surface of a profile bar, preferably a round bar. It is advantageous when the varnishing heads are arranged in pairs opposite to one another.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 7*a* is a front view of an inventive varnishing device with four varnishing heads, as seen from the front in a movement direction of the workpiece;

FIG. 7*b* is a view showing a cross-section through the varnishing device of FIG. 7*a*, transversely to the movement direction of the workpiece;

FIG. 7*c* is a view showing a cross-section through a workpiece after passage of the first varnishing head pair of the varnishing device of FIG. 7*a* and 7*b*; and FIG. 7*d* is a view showing a cross-section through the workpiece of FIG. 7*c* after passage of the second varnishing head pair of the varnishing device of FIG. 7*a* and 7*b*.

DESCRIPTION OF PREFERRED EMBODIMENTS

In the description of the present invention the terms "forward" and the word "rearward" with respect to the varnishing head and the varnishing device will identify their positions relative to the movable workpiece. A first position of the varnishing head (substantially the application nozzle) is located from a point of the workpiece forwardly of a second position of the varnishing head (substantially the suction nozzle).

Figure 1:
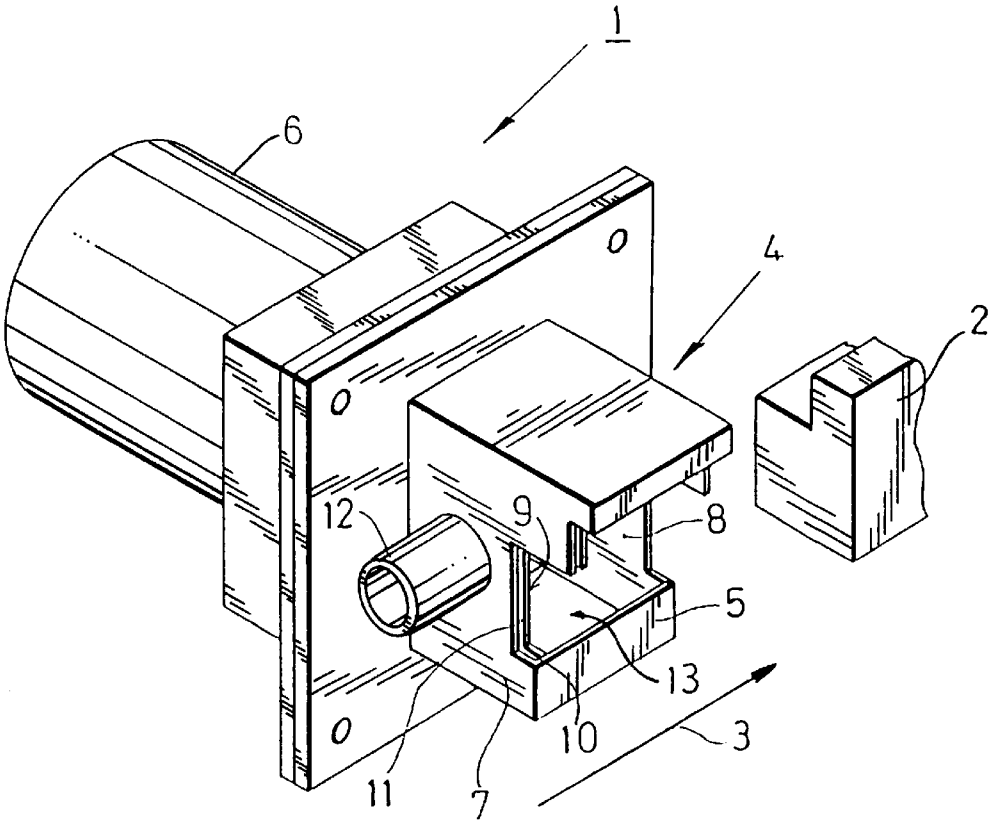
FIG. 1 is a view showing a first embodiment of a varnishing head in accordance with the present invention, in inclined representation and inclinedly from the front.

In FIG. 1 a varnishing head 1 is shown in an inclined representation together with a rear end of a movable workpiece 2 which moves in direction of the arrow 3 on the varnishing head 1. The arrow 3 shows however the direction of a relative movement between the workpiece 2 and the varnishing head 1. The varnishing head 1 in a preferable embodiment is stationary or approximately stationary; however, it can also move along the round workpiece 2.

The workpiece 2 is a rectangular bar which is stepped at its one corner. The side surfaces which are shortened by the step and the surfaces which are formed by the step are thoroughly varnished, as well as a smaller strip of the both adjoining side surfaces. For this purpose, the varnishing head 1 has a box-shaped nozzle arrangement 4 which is closed toward the workpiece 2 by a bottom 5 and is provided at the opposite side with a suction connection 6.

The bottom 5, the front side wall 7 and the rear side wall 8 of the nozzle device 4 are complementary to the profile of the workpiece. They are formed so that an opening is formed and oriented so that when the workpiece 2 passes through, it the surfaces to be coated are covered and a small air gap is left at all sides of the workpiece.

A partition 9 extends at a small distance from the front side wall 7 and parallel to it. It is cut out similarly to the front side wall 7 and together with it forms a slot 10 which faces the workpiece and extends transversely to the movement direction 3. The slot 10 represents a mouth of an application nozzle 11. The application nozzle 11 is closed at the end of the partition 9 facing away front the slot 10 and near this end is connected through a passage of the front side wall 7 with a varnish connection 12. The varnish connection is arranged at a pipe on the front side wall 7.

The space between the partition 9 and the rear side wall 8 forms a suction nozzle 13. The suction nozzle is located beyond the application nozzle 11 and extends transversely to the movement direction 3 over the same length. They can however be arranged in a reverse order.

In operation the suction connection 6 and the varnish connection 12 are connected to a suction conduit and a varnish conduit as shown in the German patent document DE 42 07 090 C2. Its content is incorporated here by a reference. Simultaneously, the workpiece 2 moves in the direction 3 through the opening of the nozzle arrangement 4. The aspirated air flows from the front to the rear between the slot 10 and the facing surface of the workpiece 2, and due to the dynamic underpressure aspirates varnish from the application nozzle 11, which is then deposited in a thin, uniform layer on the workpiece. The varnish conveyance can be performed in some cases by a not shown varnish pump and controlled correspondingly. Its conveyance can be performed so that the suction of the air stream behind the slot remains substantially without action.

The thusly coated zone of the workpiece 2 passes under the suction nozzle 13. The suction nozzle aspirates excessive varnish. In particular, in prevents the varnish application on the side flanks where the varnish runs outwardly.

The viscosity of the varnish, the flow speed of the air behind the slot 10, and the dimensions of the application nozzle 11 determine the varnish throughput. Together with this parameter, the speed in direction 3 of the workpiece 2 determines the thickness of the varnish coating which is substantially constant over the whole width. It is possible to determine these parameters relative to one another so that only a very small varnish excess is produced, and can be removed by the suction nozzle 13. This feature is especially important when the varnish is composed of several mutual reacting components which as a rule can not be recovered any longer.

Also with utilization of a normal varnish which is hardenable in air, its repeated use is difficult since a portion of the solvent must be added which evaporize during suction. The inventive varnishing head can be however adjusted so fine that the varnish residues caught in the suction air are so low that a recovery with great production charges is favorable.

Figure 2:
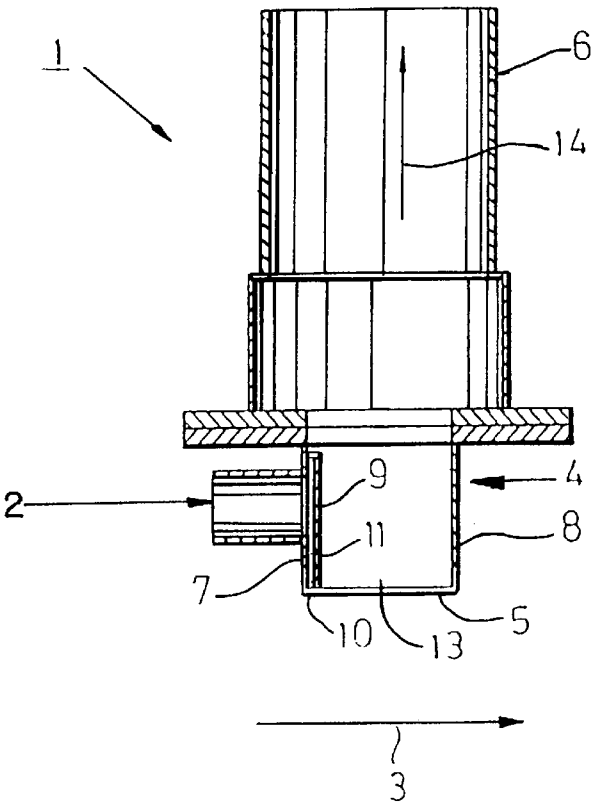
FIG. 2 is a view showing a longitudinal section of the varnishing head of the invention shown in FIG. 1.

The flow direction of the suction air is identified in FIG. 2 with the arrow 14.

The embodiments of the varnishing head 1 shown in FIGS. 3, 4 and 5, 6 are substantially similar to the embodiment of FIGS. 1, 2. The same reference numerals are used to identify the same or similar elements. For these elements, the description is dispensed with to avoid redundance. In these cases, FIGS. 1 and 2 provide corresponding information.

Figure 3:
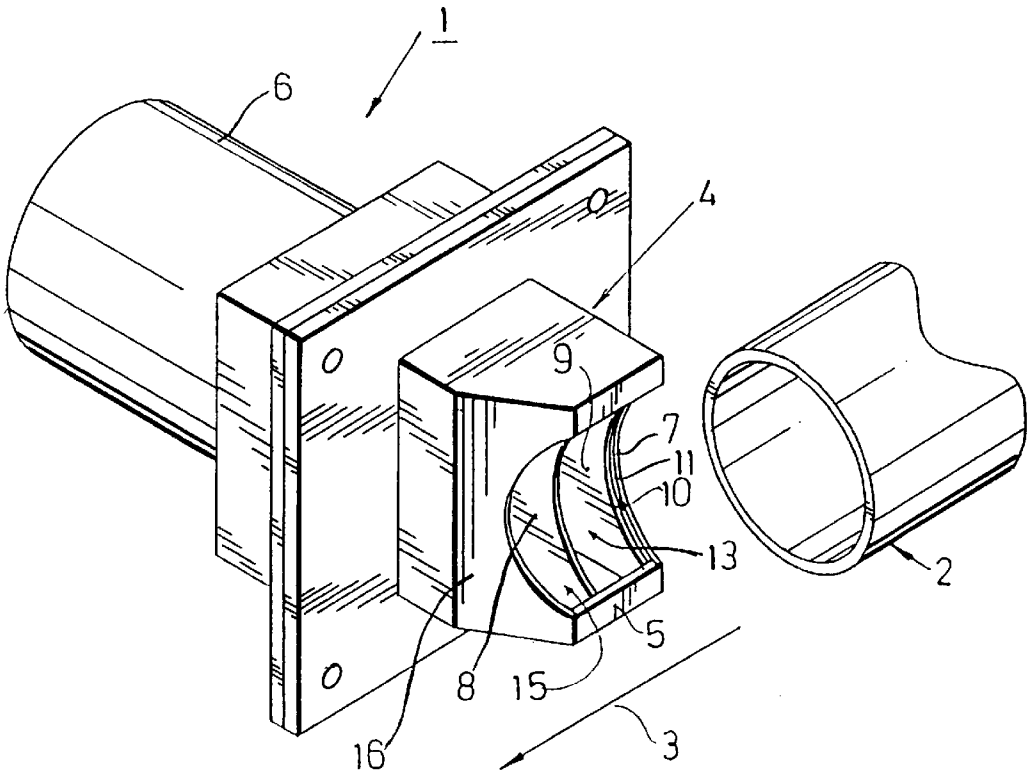
FIG. 3 is a view showing a second embodiment of the inventive varnishing head, in inclined representation and inclinedly from the front.
Figure 4:
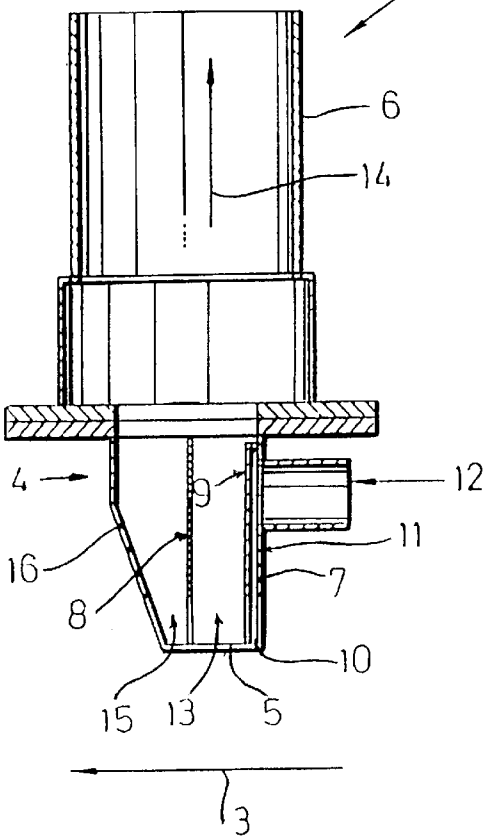
FIG. 4 is a view showing a longitudinal section of the varnishing head of the invention of FIG. 3.

In the embodiment shown in FIGS. 3 and 4, the workpiece 2 is a tube with a round cross-section which moves on the varnishing head 1 correspondingly. Both side walls 7, 8 of the nozzle device 4 are formed as circular arcs which are cut out so that the application nozzle 11 and the suction nozzle 13 extend correspondingly over a quadrant of the cross-section of the workpiece 2.

A further nozzle is arranged behind the rear side wall 8 and forms a droplet aspiration nozzle 15. It extends transversely to the movement direction 3 over the same length as the application nozzle 11 and the suction nozzle 13.

The droplet aspiration nozzle 15 is closed rearwardly by an end wall 16. The end wall approaches the side wall 8 at the front end so that the droplet aspiration nozzle 15, starting from a narrow mouth, expands in the suction direction identified with the arrow 14. This provides an intense suction flow in the mouth and therefore at the workpiece surface.

The droplet aspiration nozzle 15 opens in turn in the suction connection 6, similarly to the suction nozzle 13.

When the workpiece moves in direction of the arrow 3 on the nozzle arrangement 4, it passes the slot 10 and starts, when it runs over the suction nozzle 13, to aspirate varnish through the slot 10 to the suction nozzle 13, and also reaches the front end edge of the workpiece 2. The end edge of the workpiece 2 passes to suction chambers. During passing the droplet aspiration nozzle 15 the droplets are forcedly aspirated in direction of the arrow 14.

Figure 5:
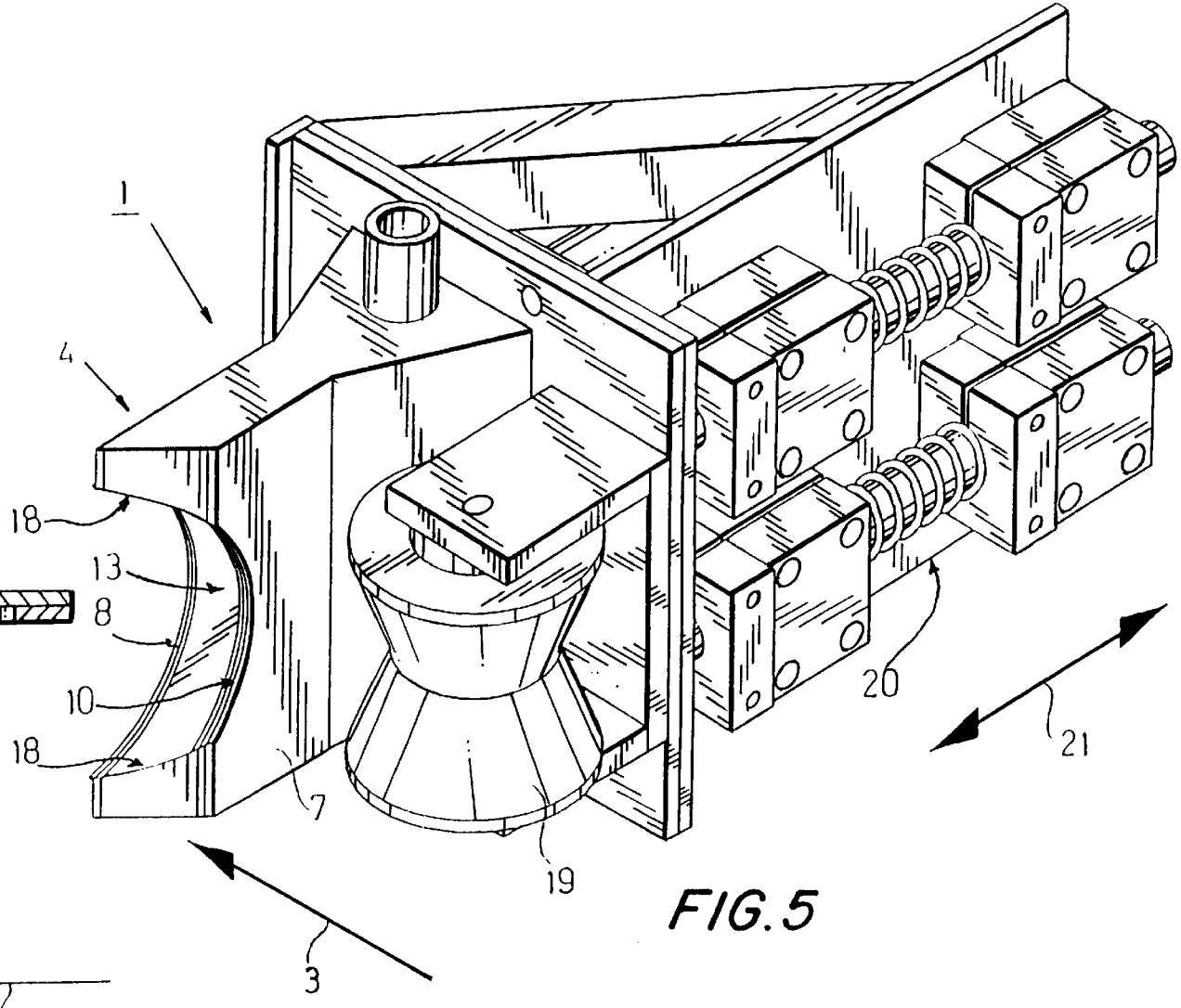
FIG. 5 is a view showing a third embodiment of an inventive varnishing head, in inclined representation and inclinedly from the front.
Figure 6:
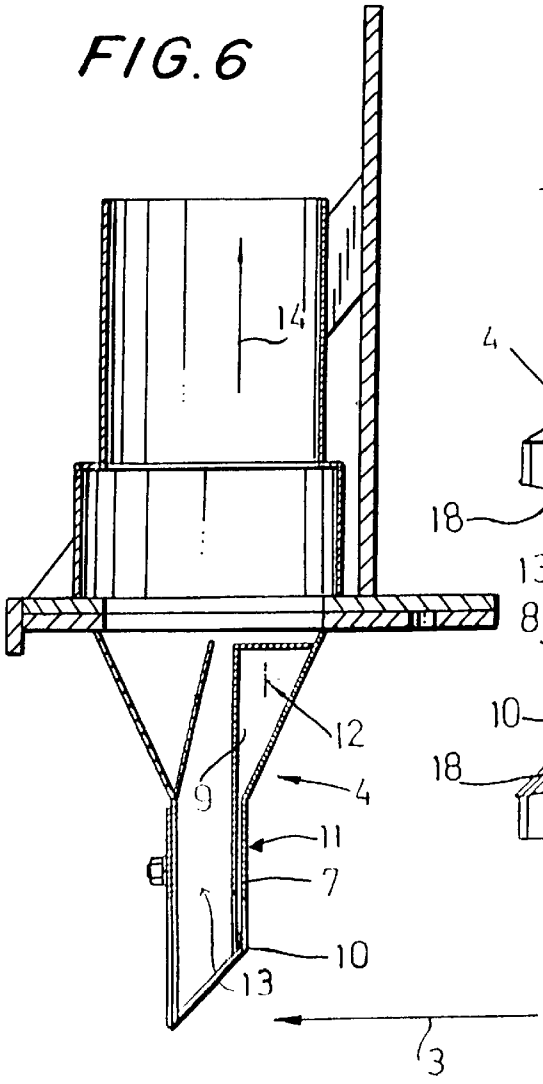
FIG. 6 is a view showing a longitudinal section through the varnishing head of the invention of FIG. 5.

The embodiment of FIGS. 5 and 6 is also provided for varnishing of a round profile bar or tube which is however not shown in FIG. 5. In contrast to the both previous embodiments, the suction nozzle 13 is provided at both sides with a wedge-shaped extension 18. Therefore, the total length of the suction nozzle 13, as seen transversely to the movement direction of the workpiece, is longer than the length of the application nozzle 11. Due to this shape, a certain lateral suction of the applied varnish is allowed, which in the both previous embodiments is prevented by the lateral underflow of the suction nozzle. When after the application of the varnish strip on the workpiece, a second varnish strip is subsequently applied flush laterally with the first strip, then the aspirated edges of the varnish strips transit in one another so fully that a uniform varnish layer is recognizable. No longer it can be seen that it is formed of several individual strips.

As can be further seen from FIG. 6, a screen 17 is arranged in a passage between the suction nozzle 13 and the suction connection 6. It minimizes the difference of the underpressure with and without the workpiece 2. When a workpiece 2 passes the varnish head 1, the underpressure increases in a sudden manner to the working pressure, so that a homogeneous varnishing over the total workpiece length is provided.

When to the contrary the suction nozzle 13 is released because of the workpiece end, the screen 13 prevents a pressure drop in the total suction device. Therefore, when a new workpiece appears, the underpressure in the suction nozzle 13 is again provided as fast as possible.

Finally, a guiding roller 19 is freely supported on the varnishing head directly near the nozzle arrangement. Its bearings are arranged stationary relative to the nozzle arrangement 4. The guiding roller 19 has the shape of a double truncated cone, with the smallest diameter in the center between the both bearings. The rotary axis of the roller extends transversely to the movement direction 3 of the workpiece, the smallest diameter is located at the same height as the center of the nozzle arrangement 4, and the distance of the guiding roller 19 from the workpiece 2 is dimensioned so that the guiding roller passes guidingly on the workpiece formed as a tube of a round bar, when the distance between the nozzle arrangement 4 (the edges of the slot 10 and the suction nozzle 13) from the surface of the workpiece is uniform and small at all sides.

Spring means 20 engage the varnishing head 1 and load it in direction against the workpiece. The varnishing head 1 is therefore movable in direction of the double arrow 21.

The guiding roller 19 maintains constant the distance between the varnishing head 1 and the workpiece 2 and therefore the width of the air gap between the nozzle arrangement 4 and the workpiece 2 which is important for a uniform varnish application.

A similar control of the varnishing head 1 can be performed in a second direction transversely to the double arrow 21. Therefore, the varnishing head 1 can provide varnishing of a multi-dimensional curved workpiece.

FIG. 7*a* and 7*b* show a varnishing device which has four varnishing heads 1 in accordance with the embodiments shown in FIGS. 5 and 6.

The varnishing heads 1 are offset relative to one another by 90°. For the first application step, they face one another in a vertical direction, and for a second application step they face one another in a horizontal direction as shown in FIG. 7*b*. Each of the varnishing heads 1 is oriented so that a quadrant is coated with varnish on the outer surface of the tube 2 with a round cross-section which forms the workpiece. When the tube 2 is moved in direction of the arrow 3 in direction of the FIG. 7*b* through the varnishing device, then first the upper and lower side of the tube 2 are provided with a varnish coat 22 as shown in FIG. 7*c*, and then both horizontal opposite sides are coated as shown in FIG. 7*d*. The varnish application in the second working step is performed so short after the varnish application in the first working step, that the yet moist edges of the adjoining applied varnish strips 22 accurately coincide with one another.

It will be understood that each of the elements described above, or two or more together, may also find a useful application in other types of constructions differing from the types described above.

While the invention has been illustrated and described as embodied in a varnishing head, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A varnishing head orientable toward a workpiece for a relative movement of a workpiece and application of a surface coating substance on a workpiece surface, the varnishing head comprising an application nozzle provided with a connection to a surface coating substance source; a suction nozzle provided with a suction connection, said application nozzle being formed as a slot nozzle facing the workpiece surface with a small distance from it and having a mouth which is formed by a slot extending transversely to a movement direction, said suction nozzle being open at a distance from said application nozzle as considered in a movement direction of the workpiece; and a droplet aspirating nozzle arranged behind said suction nozzle as considered in a movement direction of the varnishing head and open toward the workpiece.

2. A varnishing head as defined in claim 1, wherein said suction nozzle is open before said application nozzle as considered in the movement direction.

3. A varnishing head as defined in claim 1, wherein said suction nozzle is open after said application nozzle as considered in the movement direction.

4. A varnishing head as defined in claim 1, wherein said droplet aspiration nozzle is connected with said suction connection.

5. A varnishing head as defined in claim 1, wherein said droplet aspiration nozzle has a substantially same length as said suction nozzle when considered transversely to the movement direction of the workpiece.

6. A varnishing head as defined in claim 1; and further comprising means forming a narrowing between said suction nozzle and said suction connection.

7. A varnishing head as defined in claim 1, wherein said suction nozzle has a length substantially corresponding to a length of said slot as considered transversely to the movement direction of the workpiece.

8. A varnishing head as defined in claim 1, wherein said suction nozzle extends outwardly beyond at least one end of said slot as considered in the movement direction of the workpiece.

9. A varnishing head as defined in claim 1; and further comprising a guide provided for guiding of said nozzles, said guide is displaceably engageable with the workpiece and is stationarily relative to said application nozzle and said suction nozzle.

10. A varnishing device comprising at least two varnishing heads which are offset relative to one another, each of said varnishing heads having an application nozzle provided with a connection to a surface coating substance source, a suction nozzle provided with a suction connection, said application nozzle being formed as a slot nozzle facing a workpiece surface with a small distance from it and having a mouth which is formed by a slot extending transversely to a movement direction, said suction nozzle being open at a distance from said application nozzle as considered in a movement direction of a workpiece, said varnishing heads being arranged so that surfaces of the workpiece which are coated from said slots adjoin one another.

11. A varnishing device, comprising four varnishing heads, each of said varnishing heads having an application nozzle provided with a connection to a surface coating substance source, a suction nozzle provided with a suction connection, said application nozzle being formed as a slot nozzle facing a workpiece surface with a small distance from it and having a mouth which is formed by a slot extending transversely to a movement direction, said suction nozzle being open at a distance from said application nozzle as considered in a movement direction of the workpiece, said varnishing heads being offset by 90° relative to one another so that each of said varnishing heads coats a quadrant, on an outer surface of a workpiece formed as a profiled bar.

12. A varnishing head orientable toward a workpiece for a relative movement of a workpiece and application of a surface coating substance on a workpiece surface, the varnishing head comprising an application nozzle provided with a connection to a surface coating substance source; a suction nozzle provided with a suction connection, said application nozzle being formed as a slot nozzle facing the workpiece surface with a small distance from it and having a mouth which is formed by a slot extending transversely to a movement direction, said suction nozzle being open at a distance from said application nozzle as considered in a movement direction of the workpiece; and a screen arranged between said suction nozzle and said suction connection.

13. A varnishing head orientable toward a workpiece for a relative movement of a workpiece and application of a surface coating substance on a workpiece surface, the varnishing head comprising an application nozzle provided with a connection to a surface coating substance source; a suction nozzle provided with a suction connection, said application nozzle being formed as a slot nozzle facing the workpiece surface with a small distance from it and having a mouth which is formed by a slot extending transversely to a movement direction, said suction nozzle being open at a distance from said application nozzle as considered in a movement direction of the workpiece, said suction nozzle extending outwardly beyond at least one end of said slot as considered in the movement direction of the workpiece, an end of said suction nozzle which extends outwardly beyond said slot narrowing away from said slot.

14. A varnishing head as defined in claim 13, wherein said end of said suction nozzle which extends outwardly beyond of said tip is formed as a pointed end.

* * * * *